US007444935B2

(12) United States Patent
Kruempelmann et al.

(10) Patent No.: US 7,444,935 B2
(45) Date of Patent: Nov. 4, 2008

(54) METHOD FOR CORRECTION OF VARIATIONS IN THE AMOUNT OF INK APPLIED IN A PRINTING PROCESS

(75) Inventors: Martin Kruempelmann, Lengerich (DE); Dietmar Poetter, Westerkappein (DE)

(73) Assignee: Windmoeller & Hoelscher KG, Lengerich (DE)

( * ) Notice: Subject to any disclaimer, the term of this patent is extended or adjusted under 35 U.S.C. 154(b) by 0 days.

(21) Appl. No.: 10/541,849

(22) PCT Filed: Jan. 15, 2004

(86) PCT No.: PCT/EP2004/000416

§ 371 (c)(1),
(2), (4) Date: Jul. 12, 2005

(87) PCT Pub. No.: WO2004/065127

PCT Pub. Date: Aug. 5, 2004

(65) Prior Publication Data

US 2006/0102038 A1 May 18, 2006

(30) Foreign Application Priority Data

Jan. 24, 2003 (DE) ..... 103 02 747

(51) Int. Cl.
*B41F 31/02* (2006.01)

(52) U.S. Cl. ..... 101/484; 101/365; 101/DIG. 45; 400/120.02; 347/174

(58) Field of Classification Search ..... None
See application file for complete search history.

(56) References Cited

U.S. PATENT DOCUMENTS

| | | | | |
|---|---|---|---|---|
| 3,185,088 | A * | 5/1965 | Norton | 101/365 |
| 5,992,318 | A * | 11/1999 | DiBello et al. | 101/181 |
| 6,291,829 | B1 * | 9/2001 | Allen et al. | 250/559.07 |
| 6,497,179 | B1 * | 12/2002 | Allen et al. | 101/484 |
| 6,634,297 | B2 | 10/2003 | Poetter et al. | |
| 6,816,180 | B1 * | 11/2004 | Paz-Pujalt et al. | 347/224 |
| 6,960,777 | B2 * | 11/2005 | Soar | 250/559.11 |
| 2005/0016406 | A1 | 1/2005 | Veismann | |

FOREIGN PATENT DOCUMENTS

| | | | |
|---|---|---|---|
| DE | 44 13 735 | A1 | 10/1995 |
| DE | 101 45 957 | A1 | 10/2002 |
| EP | 1 249 346 | A1 | 10/2002 |
| WO | WO 03/066332 | A2 | 8/2003 |

* cited by examiner

*Primary Examiner*—Jill E. Culler
(74) *Attorney, Agent, or Firm*—Jacobson Holman PLLC

(57) ABSTRACT

A process for adjusting the print image of a rotating machine equipped with transfer rollers and actuators assigned to them includes changing the position of the rollers. During the printing operation, at least one camera records the intensity of light reflected from the printed material. The camera also feeds the recorded measured values to a control and regulation unit that compares the recorded measured values with set values, and generates corrective signals for the actuator of at least one part of the rollers involved in the printing process. Based on the corrective signals, the actuator of the relative position of the roller assigned to it is actuated until the measured values once again lie within a tolerance range.

14 Claims, 2 Drawing Sheets

METHOD FOR CORRECTION OF VARIATIONS IN THE AMOUNT OF INK APPLIED IN A PRINTING PROCESS

This is a nationalization of PCT/EP04/000416 filed Jan. 15, 2004 and published in German.

BACKGROUND OF THE INVENTION

1. Field of the Invention

The invention relates to a process for automatically adjusting the position of rollers involved in a printing process.

2. Description of the Prior Art

Such a process is known from DE 101 45 957. This patent application describes the process of automatically adjusting the positions of the rollers involved in the printing process following a job changeover. Furthermore, it contains the detailed description of a printing machine that has the characteristics of the generic term of claim 4 and therefore enables the execution of said process. This patent application does not contain an in-depth description and graphic illustration of said device and/or said process. Hence, the corresponding passages of DE 101 45 957 must be consulted in conjunction with the present application, and are herewith expressly incorporated by reference in this application as if fully set forth herein.

The application of the afore-mentioned process shortens changeover time considerably. Furthermore, said process is used to adjust the rollers involved in the printing process to one another so as to produce print images of high reproduction quality. Here the contact pressure between the rollers involved in the printing process is maintained at the lowest level possible.

Surprisingly, however, in case of high printing speeds, there is an incidence of variations in the ink intensity of the print image transferred that are attributed to variations in the ink quantity transferred during the printing process. As a rule, the ink intensity decreases. According to the opinion of the patent applicant, the reasons for this surprising effect lie in the variations of the effective radius of the rollers involved in the printing process and in the separation behavior of the printing inks. The former effect is specified in the present description.

Therefore the object of the present invention is to minimize these variations.

SUMMARY OF THE INVENTION

Accordingly, this object is attained by the features of the invention as described herein.

For the purpose of understanding the scope of the present invention, it is important that the "set values" described herein can be determined in the form described in DE 101 45 957, i.e. they can be derived in a "digital set form" of the printed image that is stored in a storage device.

However, "set values" as defined in this invention can also be determined by evaluating the characteristic progression of the intensity of the reflected light. This characteristic progression develops while engaging the rollers involved in the printing process. This characteristic progression and its evaluation for adjusting the roller positions are also described in DE 101 45 957. The set values defined in the present patent application relate to a light intensity value that is recorded by the camera at a definite point in the characteristic progression of the light intensity. This light intensity value, which is usually derived during the proof print and/or the number of light intensity values forming the composition of the print image or its sections, can be stored. It can subsequently be output from the storage device during the printing process as the set values defined in this patent application and used for regulatory purposes. However, a set value of the light intensity can also be a light intensity value that is recorded repeatedly at a definite point in the characteristic progression of the light intensity during the printing operation if necessary.

The wording, "at least one sensor—for instance, a Camera—records the intensity of light experiencing an interaction with the printed material" as used herein includes explicitly all sensors that are suited for recording light intensity. Most of these sensors known from prior art operate on the basis of photoelectric effect wherein in recent times preferably semiconductors are used as optically active materials. Semiconductors are also a component of electronic cameras. In this context, CCD cameras (CCD=Charge Coupled Device) are included among the sensor systems that are used preferably.

It is particularly advantageous if the roller position is controlled in addition to being regulated in accordance with the invention. For this purpose the position of the print rollers can be controlled merely as the function of the speed, preferably before using the regulation in accordance with the invention. Empirical values form the basis of this control that are stored, for instance, in the form of a calibration table in which a position value is assigned to a speed value. Of course positions can be assigned to printing speeds even with the help of appropriately adjusted algorithms or derivatives. The present description also provides an example for this subject area.

Advantageous processes in which at least one sensor records the intensity of the light experiencing an interaction with the printed material are also processes measuring the transmission of light through the printing substrate. For this purpose, the intensity of the light falling on the printing substrate should be known so that the absorption of the printing substrate results from the difference between the incident light and the transmitted light. It is therefore advantageous to use a light source that provides the incident light of known intensity. This radiation can take place under standard test conditions. This can be allowed for by a box that is shielded from light and that protects the substrate at the place of measurement, for example, as well as the light source and the sensor from ambient light.

Even in these embodiments of the invention, the intensity of the light experiencing an interaction with the printed material is recorded. In this connection, it is immaterial whether this interaction is in the form of a transmission and/or absorption, a reflection, refraction or any other interaction process between light and print image.

Additional embodiments of the invention are explained in the present description and in the claims, with reference being had to the accompanying drawings forming a part hereof.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
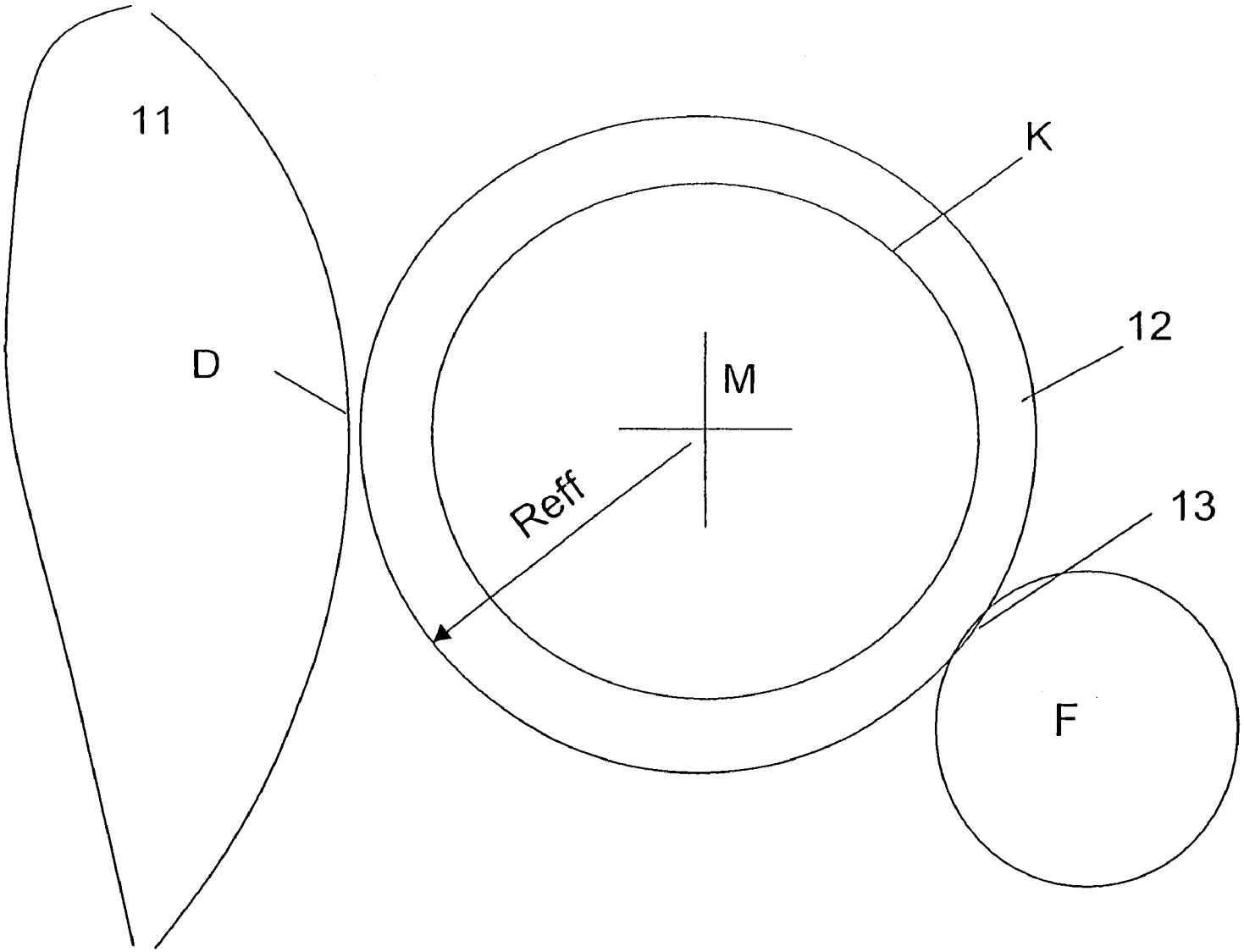
FIG. 1 an illustration of the term "effective radius."

FIG. 1 illustrates the position of the plate roller K in an example of an inking unit comprising the plate roller K during the printing process. The plate roller K and other flexible materials involved in the printing process such as the rubber coating (not illustrated in the drawing figures) that can also be present on the impression roller in other flexographic printing machines and the printing substrate (also not illustrated) are exposed to strong forces in the printing process. Thus the plate 12 is compressed along the pressure line D between the impression roller 11 and the plate roller K. A similar process takes place on the pressure line 13 between the plate roller K and the inking roller F. During a fast rotation of the roller K around its rotation axis M it is possible that the deformation, particularly of the plate, on the aforementioned pressure line K and 13 is no longer compensated for by the reset forces of the squeezed material 11, 12, K before the squeezed material reaches the pressure line D again. Therefore in this case, the effective radius $R_{eff}$, that indicates the distance between the outer circumference of the plate and the rotation axis M immediately before the pressure line D is reached again, falls. However, this effective radius $R_{eff}$ is decisive for the quality of the printing process. In the case described above of the shrinkage of the effective radius, the physical pressure on the pressure line D falls, adversely affecting the ink transfer on the printing substrate. In this case the operator of the printing machine or the machine control system of a flexographic printing machine should place the plate roller more strongly against the impression roller 11.

However, in view of the high centrifugal forces, the use of some materials can lead to an increase in the effective radius $R_{eff}$ which results in an increase of the physical pressure on the pressure line D. In this case the plate roller K is pulled out somewhat further from the impression roller 11. Both processes are summarized for the purposes of this application by the technical term "dynamic infeed." As has been mentioned already, even the ink separation behavior as a function of the printing speed can change and thus influence the ink transfer.

Figure 2:
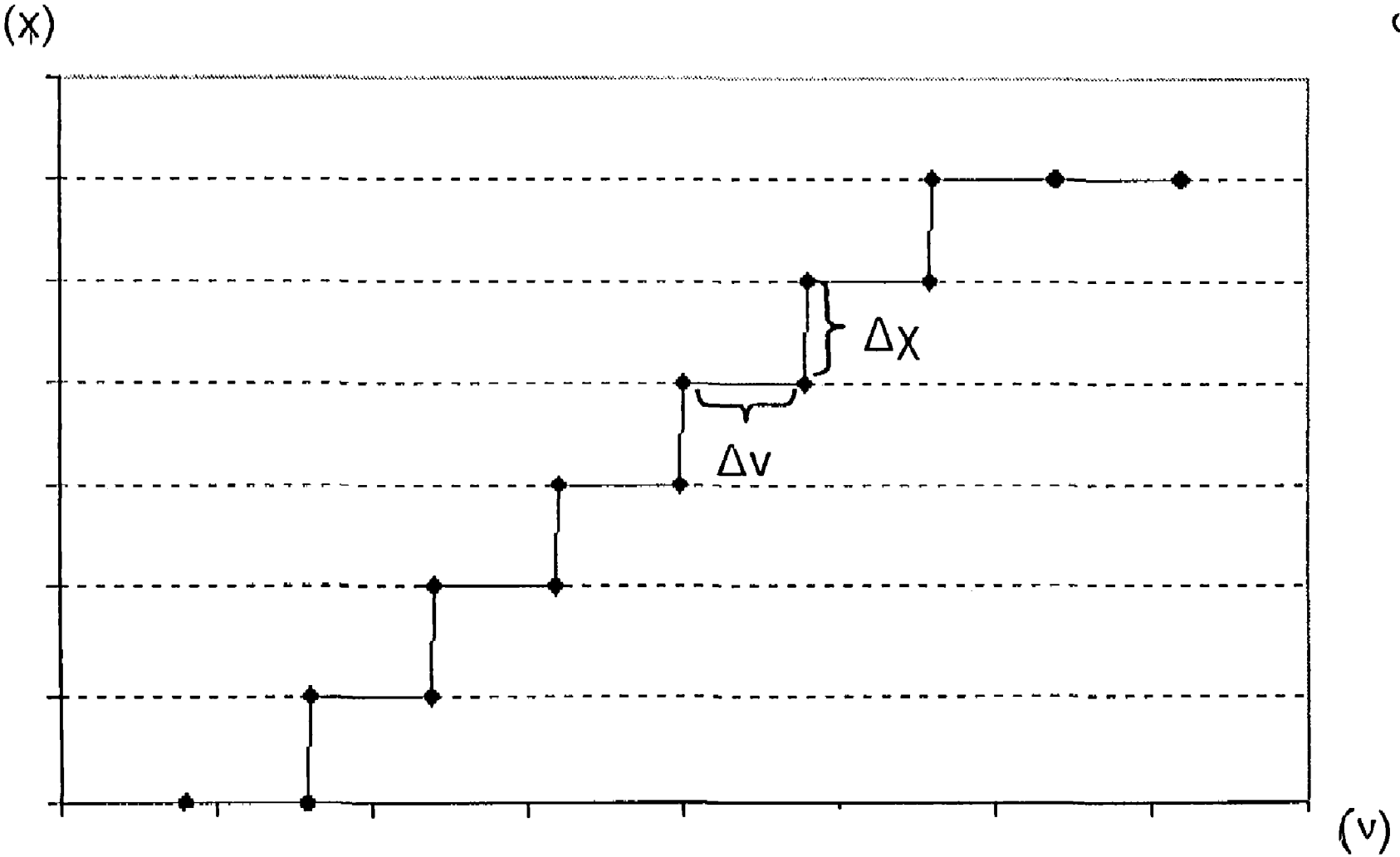
FIG. 2 an example for an operation based on which a roller position is controlled in relation to the printing speed.

FIG. 2 illustrates an operation that forms the basis of the correction of the position of a roller x in relation to the speed v. The operation has a staircase-like form, i.e. an increase of printing speed after certain speed intervals Δv leads to infeed processes by Δx. In the case of a flexographic printing machine, this usually means that the plate roller is moved further in the direction of the impression roller in case of an increase in the speed. Then, as a rule, even an additional infeed of the anilox roller on the plate cylinder ought to be necessary. The illustrated devices and processes can be used particularly advantageously in flexographic printing and intaglio printing.

The illustrated option of the speed-dependent control of the roller positions can be advantageously combined with the process according to the invention if the speed-dependent process of control is executed first followed by the regulation process with the help of the evaluation of the print image.

As has been mentioned already, even other operations, algorithms or calibration tables can be consulted for the speed-dependent control. In this connection, even linear or asymptotical dependencies between printing speed (v) and roller position (x) are also possible.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

List of reference symbols

| | |
|---|---|
| 11 | Impression cylinder |
| 12 | Plate |
| 13 | Anilox roller-plate roller pressure line |
| K | Plate roller |
| D | Pressure line of the plate roller on the impression cylinder |
| F | Inking roller |
| M | Rotation axis |
| $R_{eff}$ | Effective radius of a plate roller |
| x | Position of a roller |
| v | Printing speed |
| Δv | Speed interval |
| Δx | Infeed process |

What is claimed is:

1. A process for adjusting the print image of a rotation printing machine, comprising ink transfer rollers including a plate roller, and actuators assigned to them, with which it is possible to change a position of the rollers, and in which at least one sensor measures and records a value of an intensity of light experiencing an interaction with a printed material and that the recorded measured values are fed to a control and regulation unit, that compares the recorded measured values with set values and that generates corrective signals for the actuator of at least one part of the rollers involved in the printing process based on which the actuator changes a relative position of the roller assigned to it until the measured values once again lie within a tolerance range wherein during the printing process at least one sensor records measurements of the intensity of light experiencing an interaction with the printed material, during the printing operation the measured values are assigned to the ink transferred in at least one inking unit, during the printing operation the control and regulation unit generates corrective signals for the actuator of at least one part of the rollers of the respective inking unit involved in the printing process, such that for a variation in the printing speed, the control and regulation unit generates additional corrective signals based on which the actuators adjust the roller positions in relation to the printing speed, so that the variations in the ink quantity transferred onto a unit of area of the print image remain within a set range, the control and regulation unit determining the additional corrective signals based on stored calibrations that associate a plate roller speed with a plate roller position.

2. The process according to claim 1, wherein for the variation in the printing speed, the control and regulation unit generates additional corrective signals based on calibration tables or algorithms that are stored in a storage device.

3. The process according to claim 1, wherein the sensor records the intensity of light that has penetrated the printed material.

4. The process according to claim 3, wherein at least one light source supplies the light to a side of the printed material that is opposite to the sensor.

5. A rotation printing machine comprising:

ink transfer rollers including a plate roller, and actuators assigned to them, wherein at least one of the actuators can change a relative position of the roller assigned to it based on corrective signals;

at least one sensor that measures and records a value of an intensity of light experiencing an interaction with a printed material;

a control and regulating unit that compares the recorded measured values with set values and that generates the corrective signals for the actuator of at least one part of the rollers, wherein the control and regulating unit assigns the values measured during the printing operation to an amount of ink transferred in the inking unit, and for a variation in a printing speed, the control and regulating unit generates additional corrective signals based on which the actuators adjust the roller positions in relation to the printing speed, the control and regulating unit determining the additional corrective signals based on stored calibrations that associate a plate roller speed with a plate roller position.

6. The machine according to claim 5, wherein the sensor measures the light intensity in various spectral ranges.

7. The machine according to claim 5, wherein the sensor is a camera.

8. A process for adjusting a quantity of ink transferred in a printing operation, comprising:

illuminating a printed material during the printing operation with a light of a predetermined intensity;

measuring the intensity of the light that interacts with the printed material;

evaluating the measured intensity with a control and regulation unit that compares the measured intensity with a set intensity and that associates the measured intensity with a quantity of ink transferred from a respective inking unit;

generating a first corrective signal for an actuator associated with each of a first and a second ink transfer roller of the inking unit that include a plate roller and an inking roller, the actuators adjusting a relative position of the ink transfer rollers so that the measured intensity lies within a set intensity range; and detecting a speed of the printing operation by determining (i) an effective radius of the rotating plate roller and (ii) a rotational speed of the plate roller such that for a variation in the printing speed, the control and regulation unit generates a second corrective signal based on which the actuators further adjust the relative position of the ink transfer rollers in relation to the detected printing speed so that a quantity of ink transferred onto the printed material remains within a set ink quantity range.

9. The process according to claim 8, wherein the step of measuring the light intensity includes measuring the light that penetrates the printed material.

10. The process according to claim 9, wherein the step of measuring the light intensity includes detecting the light with a sensor on a side of the printed material that is opposite a source of the light.

11. A process for adjusting a quantity of ink transferred in a printing operation, comprising:

illuminating a printed material during the printing operation with a light of a predetermined intensity;

measuring the intensity of the light that illuminates the printed material;

evaluating the measured intensity by comparing the measured intensity with a set intensity and associating the measured intensity with a quantity of ink transferred from a respective inking unit;

providing a corrective signal to an actuator associated with each of a plate roller and an inking roller of the inking unit, the actuators adjusting a relative position of the plate roller and the inking roller so that the measured intensity lies within a set intensity range;

detecting a speed of the printing operation by determining a rotational speed of the plate roller; and providing a corrective signal to the actuators based on the detected printing speed such that the actuators further adjust the relative position of the plate roller and the inking roller so that the ink quantity transferred onto the printed material is within a set ink quantity range, the steps of detecting the speed of the printing operation and providing the corrective signal based thereon to the actuators being performed before the steps of evaluating the measured intensity and providing the corrective signal based thereon to the actuators.

12. A process according to claim 11, wherein the step of adjusting the relative position of the plate roller and the inking roller includes moving the plate roller and the inking roller relative to a position of an impression roller that is in operative communication with the plate roller.

13. A printing machine comprising:

a light source having a predetermined light intensity that illuminates a printed material during a printing operation;

a sensor located on a side of the printed material opposite the light source that measures the intensity of the light received through the printed material;

a detector that determines a speed of the printing operation by detecting a rotational speed of a plate roller that operatively communicates with an inking roller and with an impression roller, including determining an effective radius of the rotating plate roller based on (i) a distance between a rotation axis of the plate roller and an outer circumference of the plate roller and (ii) a contact pressure between the plate roller and the impression roller or between the plate roller and the inking roller; and a control and regulating unit that (i) evaluates the measured light intensity by comparing the measured intensity with a set intensity, associates the measured intensity with a quantity of ink delivered from an inking unit, and provides a first corrective signal to actuators that adjust a relative position of the plate roller and the inking roller so that the measured light intensity lies within a set intensity range, and (ii) evaluates the detected printing speed and provides a second corrective signal based thereon to the actuators, which further adjust the relative position of the plate roller and the inking roller such that the ink quantity transferred onto the printed material is within a set ink quantity range.

14. A printing machine comprising:

a light source having a predetermined light intensity that illuminates a printed material during a printing operation;

a sensor located on a side of the printed material opposite the light source that measures the intensity of the light received through the printed material;

a detector that determines a speed of the printing operation by detecting a rotational speed of a plate roller that operatively communicates with an inking roller and with an impression roller; and a control and regulating unit that (i) evaluates the measured light intensity by comparing the measured intensity with a set intensity, associates the measured intensity with a quantity of ink delivered from an inking unit, and provides a first corrective signal to actuators that adjust a relative position of the plate roller and the inking roller so that the measured light intensity lies within a set intensity range, and (ii) evaluates the detected printing speed and provides a second corrective signal based thereon to the actuators, which further adjust the relative position of the plate roller and the inking roller such that the ink quantity transferred onto the printed material is within a set ink quantity range, the second corrective signal being based on stored calibrations that associate a plate roller speed with a plate roller position.

* * * * *